US009745884B2

(12) United States Patent
Noguchi

(10) Patent No.: US 9,745,884 B2
(45) Date of Patent: Aug. 29, 2017

(54) EXHAUST MUFFLER

(71) Applicant: FUJI JUKOGYO KABUSHIKI KAISHA, Tokyo (JP)

(72) Inventor: Masanori Noguchi, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 15/014,301

(22) Filed: Feb. 3, 2016

(65) Prior Publication Data

US 2016/0222865 A1 Aug. 4, 2016

(30) Foreign Application Priority Data

Feb. 4, 2015 (JP) ..... 2015-020305

(51) Int. Cl.
*F01N 3/10* (2006.01)
*F01N 3/00* (2006.01)
(Continued)

(52) U.S. Cl.
CPC ..... *F01N 13/082* (2013.01); *F01N 1/083* (2013.01); *F01N 3/2066* (2013.01); *F01N 3/2885* (2013.01); *F01N 13/1888* (2013.01)

(58) Field of Classification Search
CPC ..... F01N 13/082; F01N 3/2066; F01N 13/20; F01N 13/1888; F01N 1/083; F01N 1/14;
(Continued)

(56) References Cited

U.S. PATENT DOCUMENTS 4,854,417 A * 8/1989 Uesugi ..... F01N 1/089 181/238
6,955,043 B2 * 10/2005 Schlossarczyk ..... F01N 1/089 181/238
(Continued)

FOREIGN PATENT DOCUMENTS

JP 59-029721 2/1984
JP 05-256129 10/1993
(Continued)

OTHER PUBLICATIONS

Office Action dated Apr. 26, 2016 in Japanese Patent Application No. 2015-020305. Japanese with English Translation. 5 Pages.

*Primary Examiner* — Phutthiwat Wongwian
*Assistant Examiner* — Diem Tran
(74) *Attorney, Agent, or Firm* — Smith, Gambrell & Russell, LLP

(57) ABSTRACT

An exhaust muffler to be attached to an engine body includes a casing that includes: a rear member facing the engine body and a front member opposing to the rear member while maintaining a gap between the front member and the rear member, the gap forming a path in which exhaust gas discharged from the engine body flows; at least one guiding member that is disposed in the gap of the casing, extends from the rear member to the front member, and has a through-hole into which a fastening member that fastens the casing to the engine body is inserted; and a catalyst holding member that holds a catalyst that purifies the exhaust gas and is accommodated in the gap of the casing while being supported by the at least one guiding member.

20 Claims, 4 Drawing Sheets

(51) Int. Cl.

| | |
|---|---|
| ***F01N 13/08*** | (2010.01) |
| ***F01N 3/20*** | (2006.01) |
| ***F01N 3/28*** | (2006.01) |
| ***F01N 13/18*** | (2010.01) |
| ***F01N 1/08*** | (2006.01) |

(58) Field of Classification Search
CPC ..... F01N 3/2885; F01N 2270/00; F01N 2270/06; F01N 2550/14; F01N 3/05
USPC ..... 60/299
See application file for complete search history.

(56) References Cited

U.S. PATENT DOCUMENTS

| | | | | |
|---|---|---|---|---|
| 7,448,204 | B2 * | 11/2008 | Nishimura | F01N 3/22 60/284 |
| 8,904,766 | B2 * | 12/2014 | Saito | F01N 3/0335 60/299 |
| 2006/0026953 | A1 | 2/2006 | Tsutsui | |
| 2014/0308175 | A1 * | 10/2014 | Doura | F23R 3/60 422/176 |

FOREIGN PATENT DOCUMENTS

| | | |
|---|---|---|
| JP | 07-042544 | 2/1995 |
| JP | 2006-046264 | 2/2006 |
| JP | 2008-180117 | 8/2008 |

* cited by examiner

EXHAUST MUFFLER

CROSS-REFERENCE TO RELATED APPLICATION

The present application claims priority from Japanese Patent Application No. 2015-020305 filed on Feb. 4, 2015, the entire contents of which are hereby incorporated by reference.

BACKGROUND

1. Technical Field

The present disclosure relates to an exhaust muffler provided with a catalyst which purifies exhaust gas.

2. Related Art

Recently, regulations of exhaust gas has become stricter not only for engines for automobiles, but also for general purpose engines used for construction machineries, agricultural machineries, etc. Therefore, for example, Japanese Unexamined Patent Application Publication Nos. H7-042544, H5-256129, and S59-029721 disclose general purpose engines which have a catalyst inside an exhaust muffler.

Meanwhile, the exhaust muffler is caused to vibrate when vibration is transmitted from the engine or when an exhaust pulsation is caused by exhaust gas flowing inside the exhaust muffler. Especially, since the vibration of the general purpose engines for the construction machineries is large, an attaching part of a holding member of the catalyst attached inside the exhaust muffler may be damaged and, thus, the holding member may be dropped off or the catalyst may be dropped off the holding member.

If the holding member and the catalyst are tightly fixed inside the exhaust muffler to prevent them from dropping off, the weight of the exhaust muffler may increase and, since the structure becomes complex, the cost may increase.

SUMMARY OF THE INVENTION

It is desirable to provide an exhaust muffler in which a catalyst accommodated therein hardly drops off while avoiding the increase of weight and cost.

An aspect of the present disclosure provides an exhaust muffler to be attached to an engine body. The exhaust muffler includes: a casing that includes a rear member facing the engine body and a front member opposing to the rear member while maintaining a gap between the front member and the rear member, the gap forming a path in which exhaust gas discharged from the engine body flows; at least one guiding member that is disposed in the gap of the casing, extends from the rear member to the front member, and has a through-hole into which a fastening member that fastens the casing to the engine body is inserted; and a catalyst holding member that holds a catalyst that purifies the exhaust gas and is accommodated in the gap of the casing while being supported by the at least one guiding member.

The exhaust muffler may further include an exhaust gas discharging port that is formed in the casing and discharges exhaust gas from the gap of the casing, and an external air introducing port that is formed in the front member of the casing at a position upstream of the exhaust gas discharging port in a flowing direction of the exhaust gas and introduces external air into the gap. The catalyst may be held between the external air introducing port and the exhaust gas discharging port.

The catalyst holding member may include a pair of fixing plates opposing to each other in an extending direction of the at least one guiding member. Each of the pair of fixing plates may include a fixing part in which an insertion hole into which the at least one guiding member is inserted is formed, and a pinching part that extends from the fixing part toward the exhaust gas discharging port, and pinches and holds the catalyst.

The fixing plates may be separated from the rear member and the front member of the casing.

The exhaust muffler may further include an exhaust gas introducing port that is formed in the rear member of the casing and introduces the exhaust gas from the engine body into the gap in the casing. The external air introducing port may be formed at a position opposing to the exhaust gas introducing port.

The at least one guiding member may include a pair of guiding members, and the exhaust gas introducing port may be formed between a pair of guiding members.

BRIEF DESCRIPTION OF THE DRAWINGS

The present disclosure is illustrated by way of example and not by way of limitation in the figures of the accompanying drawings, in which like reference numerals indicate like elements and in which.

DETAILED DESCRIPTION

Figure 1:
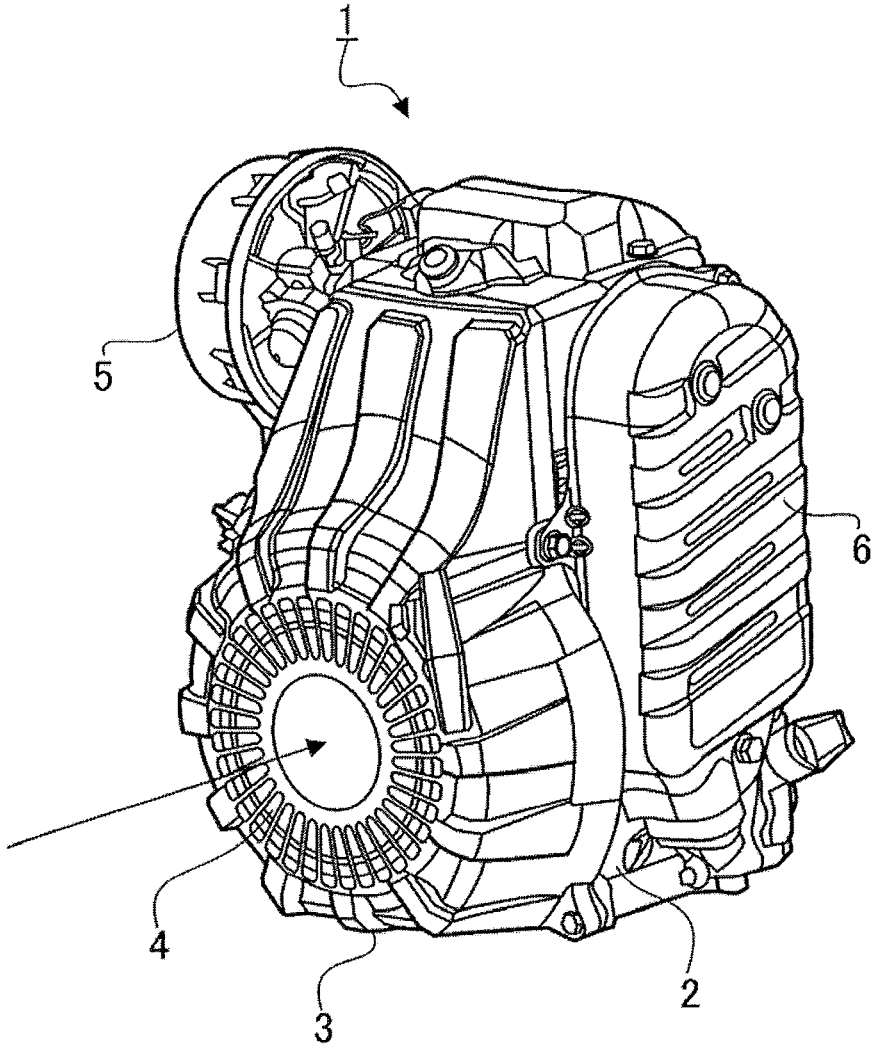
FIG. 1 is a perspective view of an engine.

Hereinafter, one preferable implementation of the present disclosure is described in detail with reference to the accompanying drawings. Dimensions, materials, other specific values, etc. are merely examples for easier understanding of the disclosure, and do not limit the present disclosure unless otherwise described. Note that in the specification and drawings, same reference numerals are assigned to elements having substantially same functions and configurations to avoid duplicate descriptions. Further, illustrations of elements which do not directly relate to the present disclosure are omitted.

FIG. 1 is a perspective view of an engine 1. The engine 1 is, for example, a general purpose engine to be mounted on a rammer as a construction machinery. A cooling fan 4 is attached to an engine body 2 and covered with a fan cover 3. A crankshaft (not illustrated) is disposed inside the engine body 2 so that a direction of its rotational axis is parallel to an arrow direction in FIG. 1, and the cooling fan 4 is fixed to one end of the crankshaft. The engine 1 is cooled by the cooling fan 4 rotated by rotation of the crankshaft.

The other end of the crankshaft protrudes toward a rear side (an opposite side of the engine body 2 from the cooling fan 4) in FIG. 1. Although detailed descriptions and illustrations are omitted herein, the other end side of the crankshaft protrudes into a rammer crankcase on a rammer body side and is coupled, via a clutch, with an eccentric crankshaft accommodated in the rammer crankcase. When the crankshaft is rotated, the rotating force is transmitted to a rolling compaction plate via the eccentric crankshaft, etc. and, thus, the rolling compaction plate is reciprocated and becomes able to compact the ground, etc.

An air cleaner 5 that removes dust, etc. from intake air is attached to the engine body 2, and a muffler cover 6 is attached to the opposite side of the engine body 2 from the air cleaner 5.

Figure 2:
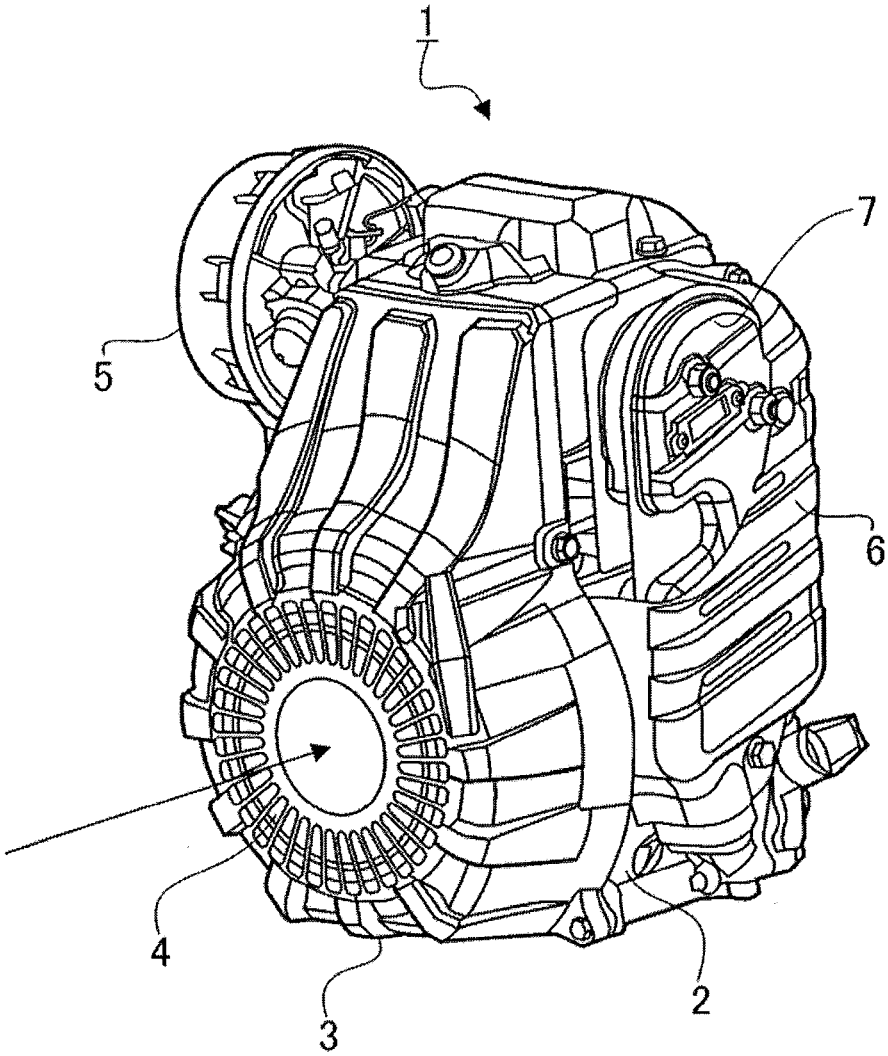
FIG. 2 is a perspective view illustrating the engine where a muffler cover in FIG. 1 is partially cut out.

FIG. 2 is a perspective view illustrating the engine 1 where the muffler cover 6 in FIG. 1 is partially cut out. As illustrated in FIG. 2, an exhaust muffler 7 is attached to a part of the engine body 2 which is covered with the muffler cover 6. After intake air is introduced into a combustion chamber (not illustrated) that is inside the engine body 2 via the air cleaner 5, and fuel is combusted in the combustion chamber, exhaust gas produced by the combustion is discharged from the combustion chamber to the exhaust muffler 7.

The exhaust muffler 7 reduces exhaust noise by reducing pressure and temperature of the exhaust gas. Further, the exhaust muffler 7 of this implementation purifies the exhaust gas via a catalyst. Hereinafter, a configuration of the exhaust muffler 7 is described.

Figure 3:
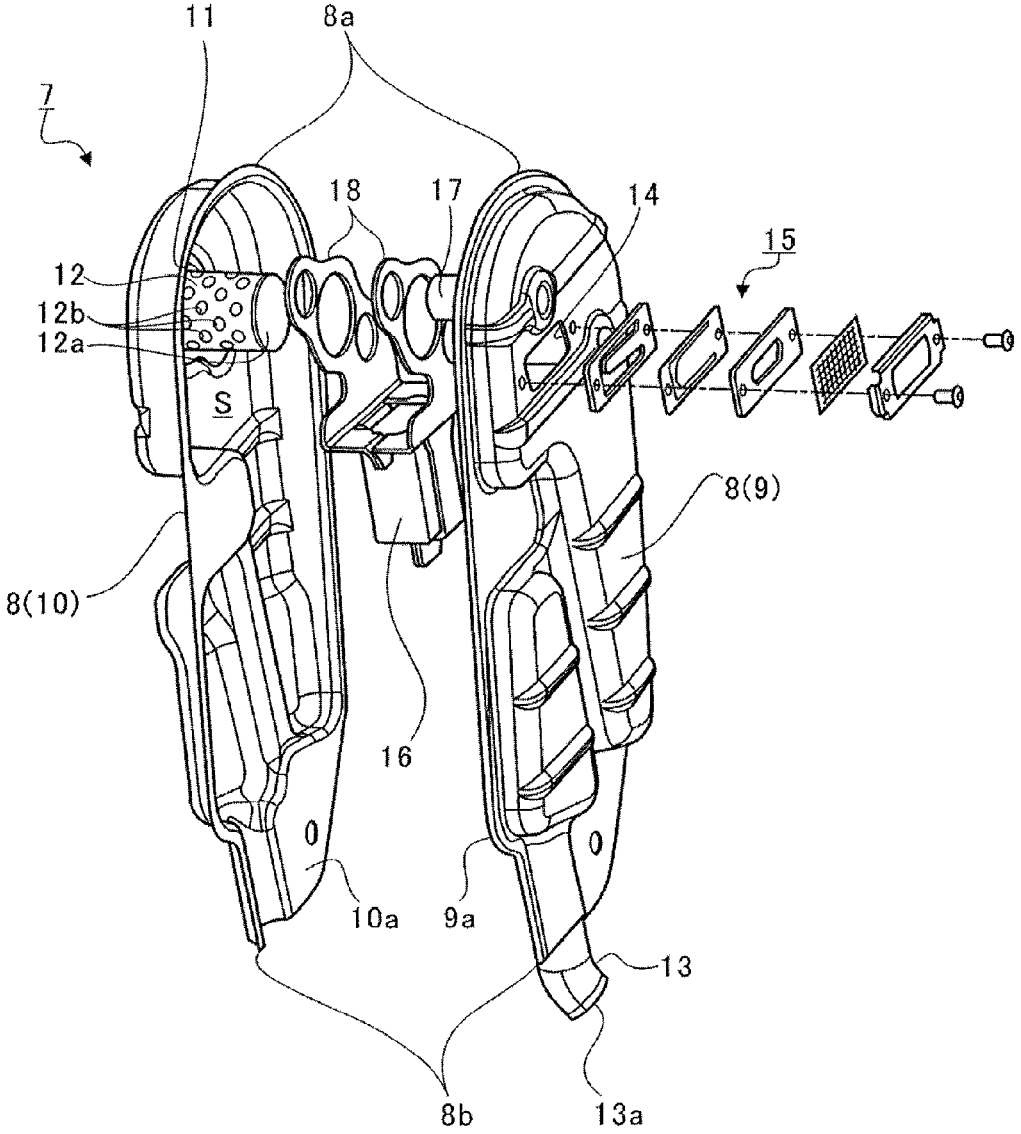
FIG. 3 is an exploded perspective view of an exhaust muffler.

FIG. 3 is an exploded perspective view of the exhaust muffler 7. As illustrated in FIG. 3, the exhaust muffler 7 has a casing 8. The casing 8 is comprised of a front member 9 and a rear member 10. The front member 9 is disposed at a side of the exhaust muffler 7 opposite from the engine body 2 described above, and the rear member 10 is disposed at a side facing the engine body 2. The front member 9 and the rear member 10 are assembled together as the casing 8 by contacting opposing surfaces 9*a* and 10*a* respectively that oppose each other.

When the front member 9 and the rear member 10 are assembled together (hereinafter, simply referred to as "when assembled"), the front member 9 opposes the rear member 10 to maintain a gap S therebetween while the opposing surface 9*a* contacts the opposing surface 10*a*.

An exhaust gas introducing port 11 is an opening formed in the rear member 10 at one end 8*a* side of the casing 8 and, when assembled, allows inside of the casing 8 to communicate with outside of the casing 8 therethrough. The exhaust gas introducing port 11 is coupled with an exhaust pipe 12 that communicates with the combustion chamber inside the engine body 2, and a tip-end side of the exhaust pipe 12 on the casing 8 side protrudes into the gap S. Here, the exhaust pipe 12 is integrally formed with the rear member 10.

A tip end 12*a* of the exhaust pipe 12 on the casing 8 side is blocked. A plurality of communicating holes 12*b* are formed in a part of the exhaust pipe 12 which is located inside the gap S when assembled. The communicating holes 12*b* allow inside of the exhaust pipe 12 to communicate with outside of the exhaust pipe 12 therethrough. The exhaust gas discharged from the combustion chamber is introduced into the gap S of the casing 8 via the communicating holes 12*b* of the exhaust pipe 12. That is, the exhaust gas introducing port 11 functions to introduce the exhaust gas from the engine body 2 into the gap S inside the casing 8.

An exhaust gas discharging pipe 13 is a pipe member disposed at the other end 8*b* of the casing 8. The other end 8*b* is at the opposite side from the one end 8*a* side where the exhaust gas introducing port 11 is formed. When assembled, an exhaust gas discharging port 13*a* that is an opening of the exhaust gas discharging pipe 13 protrudes outside the casing 8, and an opening of the exhaust gas discharging pipe 13 at the opposite side from the exhaust gas discharging port 13*a* protrudes into the gap S inside the casing 8. Thus, the exhaust gas discharging pipe 13 allows the gap S to communicate with the outside of the casing 8 therethrough.

After the exhaust gas is introduced into the gap S through the exhaust gas introducing port 11, it passes through the gap S and is then discharged from the exhaust gas discharging port 13*a*. Thus, the exhaust gas discharged from the engine body 2 flows in a path formed in the casing 8 by the gap S.

An external air introducing port 14 is formed in the front member 9 at a position opposing to the exhaust gas introducing port 11. That is, the external air introducing port 14 is located upstream of the exhaust gas discharging port 13*a* in the flowing direction of the exhaust gas. A valve mechanism 15 is provided outside the external air introducing port 14, and opens and closes the external air introducing port 14 by using a pressure difference between the inside and outside of the casing 8.

Specifically, the valve mechanism 15 opens when the pressure in the gap S inside the casing 8 decreases below the outside pressure by a certain quantity or more. When the valve mechanism 15 opens, external air is then introduced into the gap S through the external air introducing port 14.

As described above, the exhaust muffler 7 includes the catalyst 16. The catalyst 16 is disposed in the gap S inside the casing 8 and accelerates a reaction between the exhaust gas and the external air (air) which are introduced into the gap S. As the result, hydrocarbon (HC), carbon monoxide (CO), nitrogen oxide (NOx), etc. contained in the exhaust gas are reduced (purified).

Guiding members 17 are provided in the gap S of the casing 8 and extend from the rear member 10 to the front member 9. A catalyst holding member 18 holds the catalyst 16 and is accommodated in the gap S of the casing 8 while being held by the guiding members 17. The guiding members 17 and the catalyst holding member 18 are described with reference to FIGS. 4A and 4B.

Figure 4A:
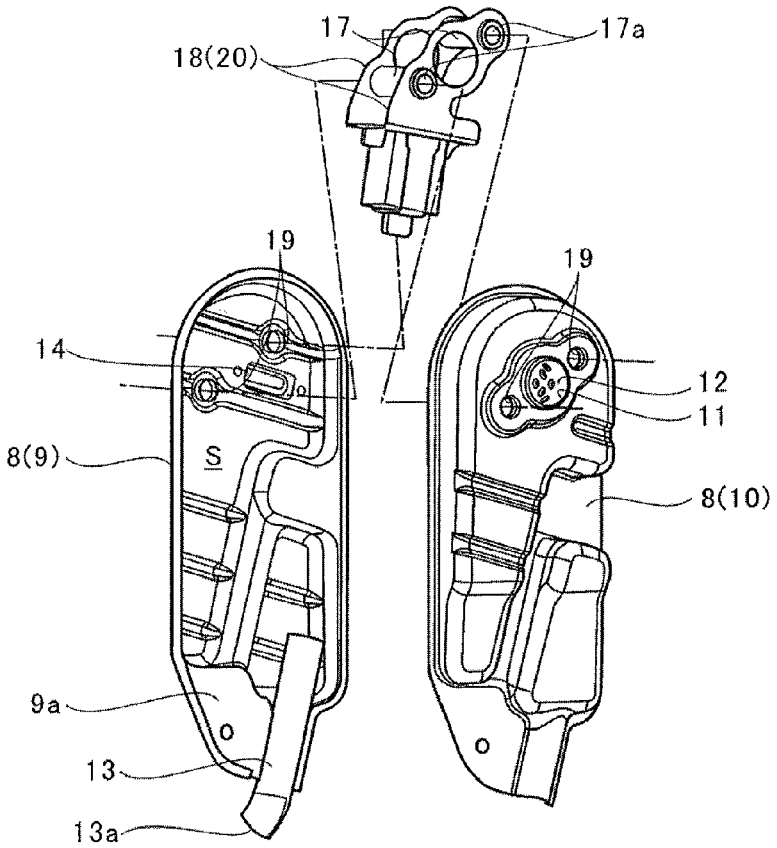
FIGS. 4A and 4B are views illustrating guiding members and a catalyst holding member.
Figure 4B:
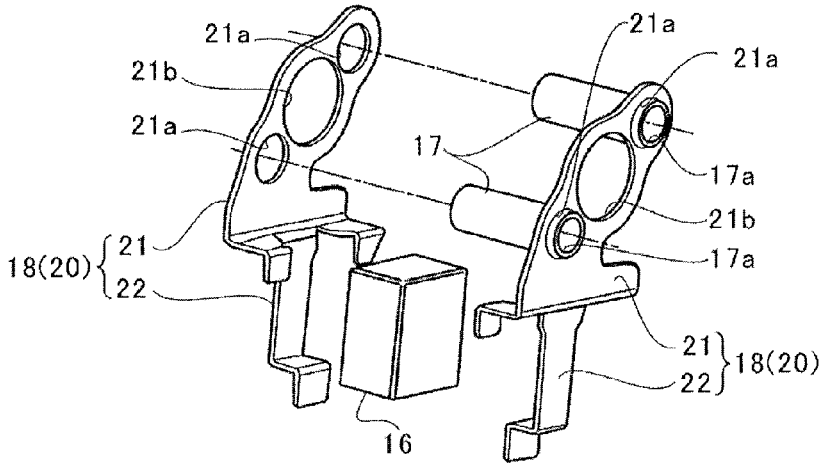

FIGS. 4A and 4B are views illustrating the guiding members 17 and the catalyst holding member 18. Specifically, FIG. 4A is an exploded perspective view of the casing 8, the guiding members 17 and the catalyst holding member 18, and FIG. 4B is an exploded perspective view of the guiding members 17, the catalyst holding member 18 and the catalyst 16. Note that, for easier understanding, FIG. 4A explodes only the casing 8 and FIG. 4B illustrates a state of the guiding member 17 to which a fixing part described later is fixed. Although FIG. 3 illustrates a spatial relation where the front member 9 is oriented front of the rear member 10, FIG. 4A illustrates a spatial relation where the rear member 10 is oriented front of the front member 9 and FIG. 4B illustrates the same spatial relation as FIG. 4A.

As illustrated in FIG. 4B, each guiding member 17 is a hollow cylindrical member where a through-hole 17*a* is formed, and a pair of guiding members 17 is disposed inside the casing 8. As illustrated in FIG. 4A, the front member 9 and the rear member 10 have outer holes 19 formed respectively at positions opposing to the through-holes 17*a* of the guiding members 17 when assembled.

When assembled, the guiding member 17 covers an opening of the outer hole 19 on the gap S side, and thus the outer hole 19 is not in communication with the gap S. A fastening member (not illustrated) such as a bolt is inserted from the front member 9 side into the outer hole 19 which is formed in both the front member 9 and the rear member 10, and into the through-hole 17*a* of the guiding member 17. A tip end of the fastening member protrudes so as to reach the engine body 2 on the rear member 10 side and is threadedly engaged with a tapped hole formed in the engine body 2, thereby fixing the exhaust muffler 7 to the engine body 2.

Further, as illustrated in FIG. 4A, the exhaust gas introducing port 11 is formed between the two outer holes 19 of the rear member 10. That is, the exhaust gas introducing port 11 is formed between the pair of guiding members 17 when assembled.

The catalyst holding member 18 is comprised of a pair of fixing plates 20. As illustrated in FIG. 4B, the pair of fixing plates 20 is shaped to be symmetrical with respect to a plane, and opposes each other in the extending directions of the guiding member 17.

Each fixing plate 20 has a fixing part 21 and a pinching part 22. Insertion holes 21*a* and an opposing hole 21*b* which penetrate in the opposing directions of the pair of fixing plates 20 are formed in the fixing part 21, and the guiding members 17 are inserted into the insertion holes 21*a*. Each guiding member 17 is fixed to the insertion holes 21*a*, for example, by welding.

The opposing hole 21*b* is formed at a position opposing to the exhaust gas introducing port 11, and the exhaust pipe 12 is inserted into the opposing hole 21*b*. The pinching part 22 extends from the fixing part 21 toward the exhaust gas discharging port 13*a* (downward in FIGS. 4A and 4B), and the pinching parts 22 of the pair of fixing plates 20 pinch and hold the catalyst 16.

When fixing the exhaust muffler 7 to the engine body 2, the exhaust muffler 7 is firmly fixed to the engine body 2 by inserting the fastening members from the front member 9 to the rear member 10, thereby improving a resistance to vibration. The guiding member 17 is to form the through-hole 17*a* into which the fastening member is inserted as described above, and therefore has a high strength and is stably disposed. Since the catalyst holding member 18 is supported by the guiding members 17, the vibration resistance can be improved and thus the catalyst 16 hardly drops off.

As illustrated in FIG. 3, a distance between the catalyst 16 and the exhaust gas discharging port 13*a* is shorter than a distance between the external air introducing port 14 and the exhaust gas discharging port 13*a*. That is, the catalyst 16 is held between the external air introducing port 14 and the exhaust gas discharging port 13*a*. As the result, the exhaust gas reaches the catalyst 16 while being mixed with the external air, and thus the reactivity of the exhaust gas with the external air can be improved.

Since the external air introducing port 14 is formed at the position opposing to the exhaust gas introducing port 11 as described above, the exhaust gas is easily mixed with the external air and thus the reactivity of the exhaust gas with the external air can further be improved.

Since the catalyst holding member 18 is comprised of the pair of fixing plates 20, and the fixing parts 21 and the pinching parts 22 are provided, the pinching parts 22 can pinch and hold the catalyst 16 even if the catalyst 16 is shaped as a bundle of wool. In addition, because the catalyst 16 is not directly fixed by welding, a situation such as a welded part of the catalyst 16 is damaged due to the vibration can be avoided. Further, since each fixing part 21 of the pair of fixing plates 20 is welded to the guiding members 17, the guiding members 17 is reinforced by the fixing plates 20, thereby increasing the strength thereof.

When assembled, the fixing plates 20 are separated from the rear member 10 and the front member 9 of the casing 8. Therefore, a heat transfer from the casing 8 to the catalyst 16 can be avoided, thereby preventing the deterioration of the catalyst 16.

Further, as described above, the exhaust gas introducing port 11 is formed between the pair of guiding members 17 and opposes the external air introducing port 14. That is, the two guiding members 17 that have a high strength and are stably disposed are provided, and the exhaust gas introducing port 11 and the external air introducing port 14 are located therebetween. Therefore, the guiding members 17 can compensate for a reduction in strength of the casing 8 due to the forming of the external air introducing port 14 and the exhaust gas introducing port 11.

As described above, according to the exhaust muffler of this implementation, the catalyst accommodated in the exhaust muffler hardly drops off while avoiding the increase of weight and cost.

Although the one preferable implementation of the present disclosure is described above with reference to the accompanying drawings, the present disclosure is, of course, not limited to the implementation described above and it goes without saying that various changes and modifications within the scope described in the claims fall under the technical scope of the present disclosure.

The present disclosure is applicable to exhaust mufflers provided with a catalyst which purifies exhaust gas.

The invention claimed is:

1. An exhaust muffler to be attached to an engine body, the exhaust muffler comprising:

a casing that includes a rear member facing the engine body and a front member opposing to the rear member while maintaining a gap between the front member and the rear member, the gap forming a path in which exhaust gas discharged from the engine body flows;

at least one guiding member, that is disposed in the gap of the casing, extends from the rear member to the front member, and has a through-hole into which a fastening member that fastens the casing to the engine body is inserted; and a catalyst holding member that holds a catalyst that purifies the exhaust gas and is accommodated in the gap of the casing while being supported by the at least one guiding member, and wherein the fastening member extends through each of the front member, guiding member and rear member.

2. The exhaust muffler of claim 1, further comprising:

an exhaust gas discharging port that is formed in the casing and discharges exhaust gas from the gap of the casing; and an external air introducing port that is formed in the front member of the casing at a position upstream of the exhaust gas discharging port in a flowing direction of the exhaust gas and introduces external air into the gap, wherein the catalyst is held between the external air introducing port and the exhaust gas discharging port.

3. The exhaust muffler of claim 2, wherein the catalyst holding member includes a pair of fixing plates opposing to each other in an extending direction of the at least one guiding member, and each of the pair of fixing plates includes a fixing part in which an insertion hole into which the at least one guiding member is inserted is formed, and a pinching part that extends from the fixing part toward the exhaust gas discharging port, and pinches and holds the catalyst.

4. The exhaust muffler of claim 3, wherein the fixing plates are separated from the rear member and the front member of the casing.

5. The exhaust muffler of claim 2, further comprising an exhaust gas introducing port that is formed in the rear member of the casing and introduces the exhaust gas from the engine body into the gap in the casing, wherein the external air introducing port is formed at a position opposing to the exhaust gas introducing port.

6. The exhaust muffler of claim 3, further comprising an exhaust gas introducing port that is formed in the rear member of the casing and introduces the exhaust gas from the engine body into the gap in the casing, wherein the external air introducing port is formed at a position opposing to the exhaust gas introducing port.

7. The exhaust muffler of claim 4, further comprising an exhaust gas introducing port that is formed in the rear member of the casing and introduces the exhaust gas from the engine body into the gap in the casing, wherein the external air introducing port is formed at a position opposing to the exhaust gas introducing port.

8. The exhaust muffler of claim 5, wherein the at least one guiding member includes a pair of guiding members, and the exhaust gas introducing port is formed between the pair of guiding members.

9. The exhaust muffler of claim 6, wherein the at least one guiding member includes a pair of guiding members, and the exhaust gas introducing port is formed between the pair of guiding members.

10. The exhaust muffler of claim 7, wherein the at least one guiding member includes a pair of guiding members, and the exhaust gas introducing port is formed between the pair of guiding members.

11. The exhaust muffler of claim 1 wherein the at least one guiding member comprises a cylindrical, tubular member defining the through-hole that extends in a front to rear direction and through which the fastening member extends.

12. The exhaust muffler of claim 1 wherein said catalyst holding member includes two, opposed pinching portions that are spaced apart in a front to rear direction and positioned so as to releasably hold therebetween the catalyst by a compression pinch relationship.

13. An exhaust muffler to be attached to an engine body, the exhaust muffler comprising:

a casing that includes a rear member facing the engine body and a front member opposing to the rear member while maintaining a gap between the front member and the rear member, the gap forming a path in which exhaust gas discharged from the engine body flows;

at least one guiding member, that is disposed in the gap of the casing, extends from the rear member to the front member, and has a through-hole into which a fastening member that fastens the casing to the engine body is inserted; and a catalyst holding member, that holds a catalyst that purifies the exhaust gas, is accommodated in the gap of the casing while being supported by the at least one guiding member, and wherein the front member of the casing further comprises an external air introduction port that is positioned upstream of the catalyst so as to feed external air to the catalyst supported by the catalyst supporting member, and the rear member of the casing comprises an exhaust gas introduction port that feeds to an exhaust gas introduction pipe extending in a front to rear direction within the gap so as to feed exhaust gas into contact with air being introduced by the external air introduction port which is formed at a position opposing the exhaust gas introduction port.

14. The exhaust muffler of claim 13 wherein the fastening member extends through each of the front member, guiding member and rear member.

15. The exhaust muffler of claim 13 wherein said catalyst holding member comprises a pair of fixing plates that oppose each other in a front to rear direction, and said at least one guiding member extends, in a front to rear direction, between and to each of said fixing plates.

16. An exhaust muffler to be attached to an engine body, the exhaust muffler comprising:

a casing that includes a rear member facing the engine body and a front member opposing to the rear member while maintaining a gap between the front member and the rear member, the gap forming a path in which exhaust gas discharged from the engine body flows;

at least one guiding member, that is disposed in the gap of the casing, extends from the rear member to the front member, and has a through-hole into which a fastening member that fastens the casing to the engine body is inserted; and a catalyst holding member, that holds a catalyst that purifies the exhaust gas, is accommodated in the gap of the casing while being supported by the at least one guiding member, and wherein said catalyst holding member comprising a pair of fixing plates that oppose each other in a front to rear direction, and said at least one guiding member extends in a front to rear direction between and to each of said fixing plates.

17. The exhaust muffler of claim 16 wherein said at least one guiding member extends through and out away from each of said fixing plates so as to extend fully between the front and rear members in a front to rear direction.

18. The exhaust muffler of claim 16 wherein said fixing plates comprise a pair of pinching parts that are positioned for pinching the catalyst therebetween so as to suspend the catalyst within the gap and in a manner that is spaced away from the front and rear members forming the gap.

19. The exhaust muffler of claim 16 wherein the fixing plates are independent plates that are respectively fixed to the at least one guiding member at spaced apart locations along the at least one guiding member.

20. The exhaust muffler of claim 16 wherein the fixing plates each have a hole that are aligned along a front to rear axis and though which holes the guiding member extends in passing fully between the front and rear members defining the gap.

* * * * *